United States Patent [19]

Kawano

[11] 4,128,329

[45] Dec. 5, 1978

[54] APPARATUS FOR PRODUCING BIAS VOLTAGE FOR USE IN ELECTROPHOTOGRAPHIC COPYING MACHINES

[75] Inventor: Haruyoshi Kawano, Kawasaki, Japan

[73] Assignee: Ricoh Company, Ltd., Tokyo, Japan

[21] Appl. No.: 727,129

[22] Filed: Sep. 27, 1976

[30] Foreign Application Priority Data

Oct. 3, 1975 [JP] Japan ..... 50-119476

[51] Int. Cl.[2] ..... G03G 15/06

[52] U.S. Cl. ..... 355/14; 355/68

[58] Field of Search ..... 118/647; 355/3 DD, 14, 355/68, 83

[56] References Cited

U.S. PATENT DOCUMENTS

| | | | |
|---|---|---|---|
| 2,956,487 | 10/1960 | Giaimo | 355/14 |
| 3,409,901 | 11/1968 | Dost et al. | 355/3 DD |
| 3,438,705 | 4/1969 | King | 355/3 DD |
| 3,654,893 | 4/1972 | Piper et al. | 355/3 DD |
| 3,815,988 | 6/1974 | McVeigh et al. | 355/3 DD |
| 3,944,354 | 3/1976 | Benwood et al. | 355/3 DD |
| 3,947,117 | 3/1976 | Basu et al. | 355/68 |
| 3,981,268 | 9/1976 | Tsukamoto et al. | 355/3 DD |

*Primary Examiner*—A. D. Pellinen

*Attorney, Agent, or Firm*—Cooper, Dunham, Clark, Griffin & Moran

[57] ABSTRACT

An apparatus for producing a bias voltage for use in an electrophotographic copying machine including a developing electrode, which apparatus assures a bias potential of a proper magnitude in response to a variation in the amount of light emitted by a light source of an exposure optical system. The apparatus comprises a transducer for converting the amount of light into a corresponding electrical quantity, and an amplifier for amplifying the electrical quantity. The apparatus also includes a differential amplifier which produces a bias potential corresponding to the variation in the amount of light to which a reference bias potential is added.

4 Claims, 8 Drawing Figures

APPARATUS FOR PRODUCING BIAS VOLTAGE FOR USE IN ELECTROPHOTOGRAPHIC COPYING MACHINES

BACKGROUND OF THE INVENTION

The invention relates to an apparatus for producing a bias voltage for application to a developing electrode of a developing unit contained in an electrophotographic copying machine.

As is recognized, the electrophotographic process comprises the step of exposing a charged surface of a photosensitive member to a light image which is projected through an exposure optical system, thereby selectively removing the surface charge to form an electrostatic latent image thereon. The latent image is converted into a visual image by bringing it into contact with a colored fine particle which is referred to as a toner. The toner is charged to the opposite polarity from the charge which forms the latent image, whereby it is electrostatically attracted thereto. While non-image areas of the latent image should be free from the deposition of any toner as a result of the loss of electric charge thereon, there remains a potential on the order of 200 to 300 volts actually in these areas because of the problem of fatigue of the photosensitive member, and the toner attaching to these areas cause a background smearing or scumming of a resulting copy image. To avoid this, it is known to utilize a developing electrode which is located in close proximity to and along the surface of the photosensitive member and which is applied with a bias potential slightly exceeding that of non-image areas, thus effectively preventing the deposition of any toner to these areas. The potential of the latent image, including non-image areas, depends on the amount of exposure applied. The less the amount of exposure, the higher the potential or vice versa. Thus, the potential of the latent image will be constant for a given amount of exposure assuming that other factors remain constant.

However, as a matter of practice, a light source used in the exposure optical system has a light output which varies with time. By way of example, FIGS. 1 and 2 show some examples the light output characteristics of fluorescent lamps. With a lamp having the characteristic as shown in FIG. 1, the light output from the fluoroescent lamp varies from the initial amount, taken as 100%, to a value between 75 and 80% in a brief time interval of the order of about 10 minutes during which a continued copying operation takes place. FIG. 2 shows the lamp output characteristic over a prolonged period of time, and it will be seen that the output will be similarly reduced to an initial value between 75 and 80% after 100 hours of use. Therefore, it will be seen that the application of a fixed bias voltage to the developing electrode cannot provide a satisfactory assurance against scumming because a variation in the amount of light output from the light source causes a change in the potential of non-image areas. Thus it is seen that it will be desirable to provide a source of bias voltage which is automatically controlled in response to a variation in the amount of light output from a light source used in the exposure optical system. In the prior art practice, there has been no remedy to correct for a variation in the light output with time although a lamp regulator is proposed to accommodate for a fluctuation in the line voltage.

SUMMARY OF THE INVENTION

In accordance with the invention, an apparatus for producing a bias voltage comprises a transducer for converting the amount of light output from a light source in an exposure optical system into an electrical quantity, and an amplifier for amplifying the electrical quantity. The transducer may comprise a cadmium sulfide photoconductive cell, for example, which exhibits the charcteristic of an increasing resistance with a decreasing amount of light. Thus, when the output of the transducer is utilized as a source of bias voltage, there can be supplied a bias potential which increases in a manner corresponding to an increase in the potential of the latent image as the amount of light decreases.

In another aspect of the invention, the apparatus for producing a bias voltage comprises a transducer for converting the amount of light from a light source in an exposure optical system into an electrical quantity, a reference bias voltage generator which produces a reference bias voltage corresponding to a reference light output from the light source, and a differential amplifier which is operative to amplify a differential variation between the electrical quantity and the voltage corresponding to the reference light output. In this instance, the transducer may comprise a solar cell. As the amount of light which irradiates the solar cell decreases, the differential amplifier produces an output which compensates for a reduction in the voltage. The output is added with a potential produced by a second reference bias voltage generator to provide a final bias voltage to the developing electrode of a magnitude which is increased by an amount corresponding to an increase in the potential of the latent image which occurs as a result of a reduction in the light output.

Therefore, it is an object of the invention to provide an apparatus for producing a bias voltage for use in an electrophotographic copying machine including a developing unit which is provided with an electrically biased developing electrode, the apparatus supplying a bias potential which compensates for a variation in the light output from a light source of an exposure optical system.

It is another object of the invention to provide an apparatus for producing a bias voltage which includes a component added thereto in accordance with an increase in the potential of the latent image as it occurs with a variation in the light output of the light source.

The above and other objects of the invention will become apparent from the following description with reference to the drawings.

DETAILED DESCRIPTION OF PREFERRED EMBODIMENTS

Figure 1:
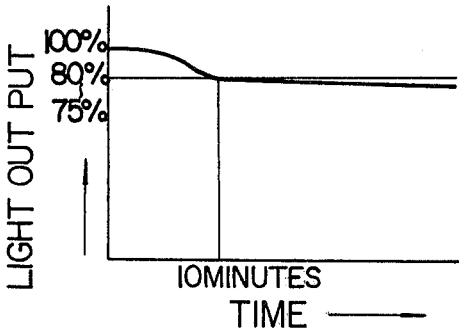
FIGS. 1 and 2 graphically show variations in the light output with time of fluorescent lamps which may be used as a light source in an exposure optical system.
Figure 2:
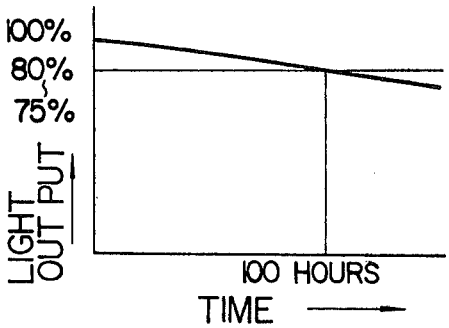
Figure 3:
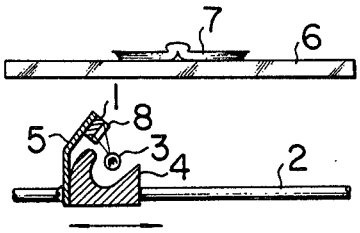
FIGS. 3 and 4 are schematic views showing embodiments of the invention.

Referring to FIG. 3, there is shown an arrangement of an exposure optical system having a moving light source and in which a transducer is adapted to move integrally with the light source. A transducer 1 is mounted on a housing 4 of a light source 3, adapted to move along a guide shaft 2, by means of a support arm 5. Light from the source 3 illuminates an original 7 placed on a receiving glassplate 6, and also impinges on the transducer 1, which operates to detect a variation in the light output therefrom with time. To this end, the transducer 1 may be disposed at a location in the vicinity of the light source 3 in which it is capable of receiving light emitted by the source 3 and in which it does not interfere with an illumination of the original 7. The transducer 1 may be associated with a suitable filter 8 depending on the application intended.

Figure 4:
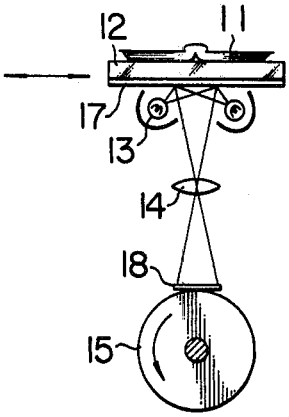
Figure 5:
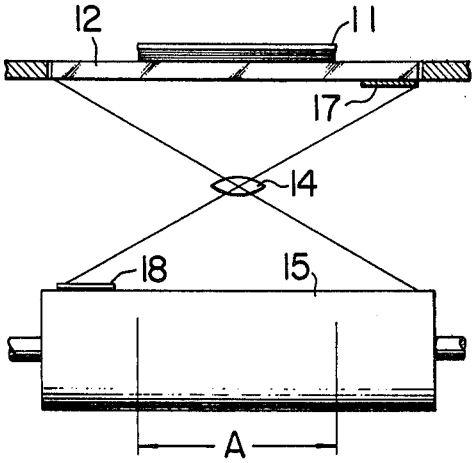
FIG. 5 is a schematic side elevation of the embodiment shown in FIG. 4.

FIG. 4 shows an arrangement for an exposure optical system of the type in which an original and a photosensitive member are adapted to move in synchronism with each other. An original 11 is placed on a receiving glassplate 12, below which is located a light source 13. Light from the source 13 irradiates the original 11 and is reflected to pass through a lens 14 to project an image of the original onto the surface of a photosensitive member 15. As illustrated in side elevation in FIG. 5, a reflecting plate 17 is located on one side of the glassplate 12 while a transducer 18 is located on the opposite side thereof in close proximity to the top of the photosensitive member 15 so that light reflected by the reflecting plate 17 may impinge on the transducer 18 after passing through the lens 14. This arrangement in which the reflecting plate 17 and the transducer 18 are located outside the effective image forming area A avoids the influence of reflecting the light from the original, upon the correct determination of a variation in the light output from the light source which usually occurs with time. Depending on the type of the exposure optical system used, the transducer may be suitably located, but it is essential that it has no adverse influence upon the imaging action and maintains a constant distance from the light source.

Figure 6:
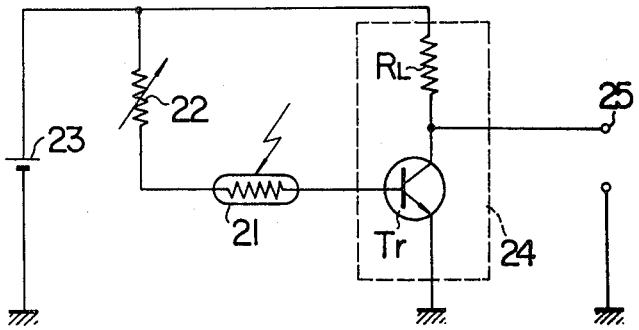
FIG. 6 is a circuit diagram of one embodiment of the invention.

Referring to FIG. 6, there is shown one embodiment of the invention which utilizes a cadmium sulfide photoconductive cell functioning as a transducer. Specifically, the cell 21 has one end connected through a variable resistor 22 with the positive terminal of a d.c. supply 23 and its other end connected with the base of a transistor Tr contained in an amplifier 24. The transistor Tr has its emitter connected with the ground as is the negative terminal of the supply 23, and has its collector connected with an output terminal 25 and is also connected thrugh an output resistor $R_L$ of the amplifier 24 with the positive terminal of the supply.

Figure 7:
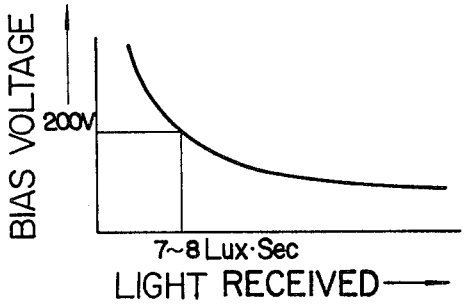
FIG. 7 graphically shows the relationship between the bias voltage or output voltage of the embodiment shown in FIG. 6 and the amount of light.

As the amount of light which irradiates the photoconductive cell decreases with time, the cell presents an increased resistance or photocurrent, resulting in a progressive increase in the output voltage or bias voltage, as shown in FIG. 7. The bias voltage must not be allowed to increase indefinitely as the amount of light decreases since otherwise serious results may be caused. For example, where developing takes place by the use of a magnetic brush, an electric discharge may be produced between the carriers, which are usually formed by iron powders, above a certain value of the bias voltage, or an electric discharge may be produced between the photosensitive member and the carriers, causing damage to the photosensitive member. An upper limit on the bias voltage depends on the type of carrier, the kind of the photosensitive member, the thickness and other factors, and usually lies on the order of about 500 volts. The end of the useful life of the lamp used as the light source may be determined when the bias voltage at terminal 25 continues to rise and approaches the upper limit. Such detection permits an immediate change of the lamp, avoiding reliance on an unreliable bias for changing the lamp after a given period time of use.

When a fluorescent lamp is used as a light source and a selenium material is used for the photosensitive member with an insulating sleeve utilized for the magnetic brush, the optimum bias voltage when the light output from the light source has reduced to 7 to 8 lux.sec is about 250 volts.

Generally, it is necessary to reduce the bias voltage V as the amount of light L increases, and the relation therebetween must be such that dV/dL is negative. However, the invention is not necessarily limited to either polarity of the derivative of dV/dL.

Figure 8:
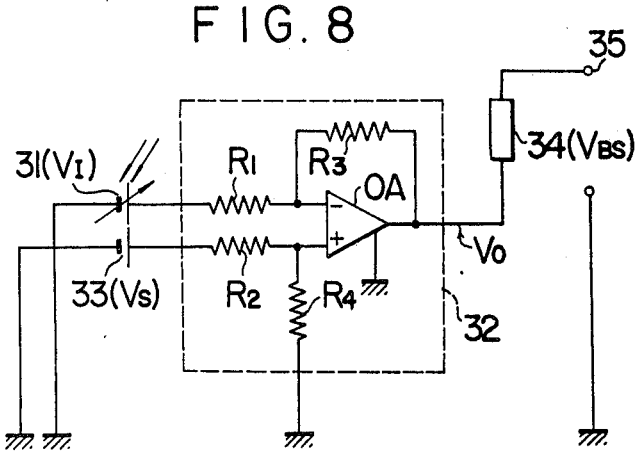
FIG. 8 is a circuit diagram of another embodiment of the invention.

FIG. 8 shows another embodiment of the invention incorporating a differential amplifier. A solar cell is used as a transducer for converting the amount of light into an electrical quantity. Specifically, a solar cell 31 has its negative terminal connected with the ground and its positive terminal connected through a resistor $R_1$ with the negative input of an operational amplifier OA contained in a differential amplifier 32. The positive input of the operational amplifier OA is connected through a resistor $R_2$ with the positive terminal of a reference supply 33, the negative terminal of which is connected with the ground. A resistor $R_3$ is connected in shunt across the output and the negative input of the operational amplifier OA, and the output of the latter is connected with an output terminal 35 through a reference bias voltage generator 34. The positive input of the operational amplifier OA is also connected with one end of a resistor $R_4$, the other end of which is connected with the ground.

The reference supply 33 generates a reference voltage corresonding to a reference value determined by the expected amount of light from the light source.

The generator 34 generates a reference bias voltage determined by the magnitude of image background potential on the photosensitive member.

Repesenting a voltage developed across the solar cell 31 by $V_I$ and the voltage of the reference supply 33 by $V_s$, the output voltage $V_O$ of the differential amplifier 32 will be represented by the equality $V_O = K_k(V_I - V_s)$ where $K_K$ is the amplification factor of the amplifier. When this output voltage is added with a voltage $V_{BS}$ produced by the generator 34, there is produced at the output terminal 35 a sum voltage represented by $V_{BS} + K_K(V_I - V_S) = V_{BS} + V_O$. Thus, as the amount of light inpinging on the solar cell decreases, the differential amplifier provides a corresponding voltage compensation to provide a corrected output voltage at the terminal 35. It should be understood that the invention is not limited to the use of a solar cell.

What is claimed is:

1. An electrophotographic copying apparatus of the type comprising:

a photosensitive member having a surface on which electrostatic latent images of originals are formed;

a scanning-type exposure optical system comprising a light source means, relatively movable with respect to said originals, for producing electrostatic latent images of said originals on said surface;

developer means for developing electrostatic latent images on said surface; and developing electrode means for creating a bias voltage adjacent said surface during development; wherein the improvement comprises:

transducer means, disposed at a fixed distance from and in the uninterrupted direct light from said light source means during the relative movement between said light source means and said originals, for converting the amount of light from said light source means into an electrical quantity;

amplifier means for amplifying the electrical quantity; and means for applying the output of the amplifier means as a source of bias voltage to said developing electrode means.

2. An apparatus according to claim 1 in which the transducer means comprises a cadmium sulfide photoconductive cell.

3. An electrophotographic copying apparatus of the type comprising:

a photosensitive member having a surface on which electrostatic latent images are formed;

an exposure optical system comprising a light source means for producing electrostatic latent images on said surface;

developer means for developing electrostatic latent images on said surface; and developing electrode means for creating a bias voltage adjacent said surface during development; wherein the improvement comprises:

transducer means, disposed at fixed distance from and in the uninterrupted direct light from said light source means, for converting the amount of light from said light source means of said exposure optical system into an electrical quantity in the form of a voltage;

first generator means for generating a reference voltage corresponding to a reference value determined by the expected amount of light from the light source means;

differential amplifier means for amplifying only a differential variation in the electrical quantity voltage from the reference value voltage;

second generator means for generating a reference bias voltage;

means for adding the output from the amplifier means and the output of the second generator means together to provide a source of bias voltage; and means for applying said bias voltage to said develoing electrode means.

4. An apparatus according to claim 3 in which the transducer means comprises a solar cell.

* * * * *